United States Patent [19]

Vockensperger et al.

[11] Patent Number: 4,807,534

[45] Date of Patent: Feb. 28, 1989

[54] DEVICE FOR EJECTING CONTAINERS, IN PARTICULAR, AMMUNITION

[75] Inventors: Hubert Vockensperger, Feldkirchen-Westerham; Franz Hieble, Neu-Ulm; Robert Gebhardt, Poing, all of Fed. Rep. of Germany

[73] Assignee: Bayern-Chemie Gesellschaft fur flugchemische Antriebe GmbH, Fed. Rep. of Germany

[21] Appl. No.: 92,056

[22] Filed: Sep. 1, 1987

[30] Foreign Application Priority Data

Sep. 6, 1986 [DE] Fed. Rep. of Germany ..... 3630082

[51] Int. Cl.[4] ..... F42B 13/50

[52] U.S. Cl. ..... 102/489; 102/202; 102/530

[58] Field of Search ..... 102/202, 204, 340, 342, 102/351, 357, 489, 530, 531

[56] References Cited

U.S. PATENT DOCUMENTS 174,325 2/1876 Tyler .
1,140,041 5/1915 Karlik .
3,014,425 12/1961 Turnbull et al. .
3,062,147 11/1962 Davis et al. .
3,667,391 6/1972 Amiable et al. .
3,726,223 4/1973 Moe .
4,558,645 12/1985 Boeder et al. .
4,714,020 12/1987 Hertsgaard et al. .

FOREIGN PATENT DOCUMENTS 2920347 11/1980 Fed. Rep. of Germany ..... 102/489
3026159 8/1982 Fed. Rep. of Germany ..... 102/489

*Primary Examiner*—Deborah L. Kyle
*Assistant Examiner*—Richard Klein
*Attorney, Agent, or Firm*—McGlew and Tuttle

[57] ABSTRACT

A device for ejecting ammunition containers from a war head has transverse to the war head longitudinal axis a bellows, which holds the ammunition containers in a plurality of concave pockets. The bellows is inflated by a gas generator including a gas-permeable tube extending along the longitudinal axis. In order to achieve a wide range of variations in the behavior of the ammunition containers in the process of being ejected, a propellant charge of the gas generator is particulate, with at least one ignition cord extending along the longitudinal axis of the tube around which a particle ignition mixture is arranged, so that the hot particles during burn-down of the ignition mixture are pressed between the particles of the propellant charge. A daming serves for building up the initial pressure required for the burning down of the propellant charge.

8 Claims, 2 Drawing Sheets

DEVICE FOR EJECTING CONTAINERS, IN PARTICULAR, AMMUNITION

FIELD AND BACKGROUND OF THE INVENTION

The invention relates in general to ammunition handling devices and in particular to a new and useful device for ejecting containers, in particular of ammunition, from a war head or similar holder.

A similar device is shown in German Patent DEP 30 26 159. The gas generator in these devices has a massive solid propellant charge in the gas-permeable tube in the middle of the bellows and so it is practically not variable with respect to the ejection behaviour of the container to be ejected.

SUMMARY OF THE INVENTION the invention provides a container ejection device permitting the ejection behaviour of the container to be ejected to be variable over a wide range in a simple manner.

In the device according to the invention a gas generator for the ejection pressure includes a gas-permeable tube preferentially damed up with a film and formed a spray pipe, into which a particulate, preferentially platelett-like propellant charge is filled. The geometry of the openings of the gas-permeable tube is adapted to the propellant charge, in order to obtain the desired ratio of the overall area of all openings of the gas-permeable tube to its surface area. The propellant charge is ignited by at least one pyrotechnic ignition cord, which lies in the center axis of the gas-permeable tube and which provides a mixture of an oxygen-releasing compound, like potassium or ammonium perchlorate, as well as a metal powder, like aluminum powder, possibly with additions, like a plastic particulate ignition mixture. Through suitable adjustment of these components including flow-out openings of the gas-permeable tube, closing-off, propellant geometry, pyrotechnic ignition cord interalia, not only the ignition and function of the gas generator can be controlled but with it also the effect of the ejecting device with respect to the ejection behaviour of the ammunition containing container, in particular.

An object of the invention is to provide a device for ejecting containers, particularly ammunition containers, which are positioned in pockets of an expandable bellow member using a gas-permeable tube which is located substantially centrically in the bellows and contains a solid propellant particulate arranged in a gas-permeable tube which is initially damed by a material which is burned away by the propellant gases when they are ignited and which includes an ignition chain for the propellant including at least one ignition cord which extends centrically over substantially the entire length of the tube and also a particulate ignition mixture placed around the ignition cord.

A further object of the invention is to provide a device for ejecting containers which is simple in design, rugged in construction and economical to manufacture.

The various features of novelty which characterize the invention are pointed out with particularity in the claims annexed to and forming a part of this disclosure. For a better understanding of the invention, its operating advantages and specific objects attained by its uses, reference is made to the accompanying drawings and descriptive matter in which a preferred embodiment of the invention is illustrated.

GENERAL DESCRIPTION OF THE PREFERRED EMBODIMENT

Figure 1:
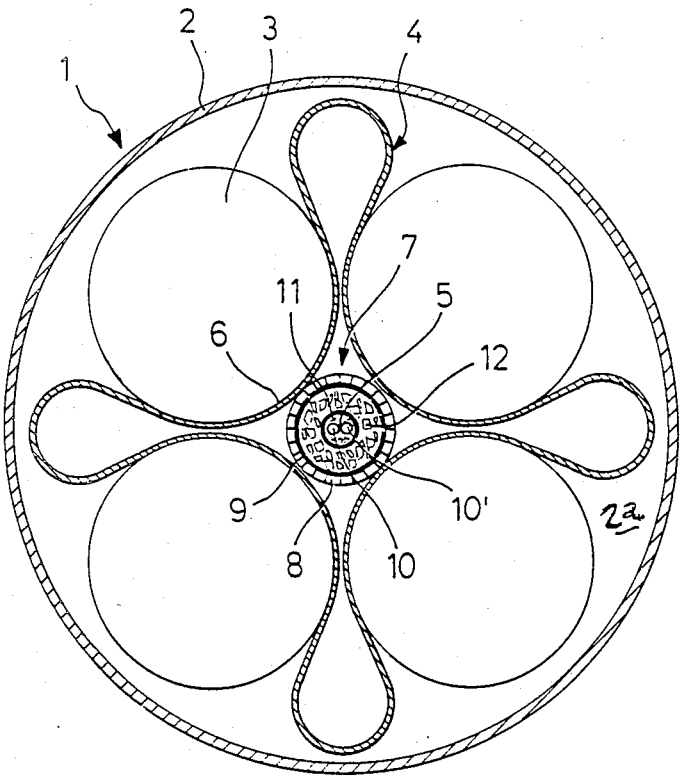
FIG. 1 is a cross section of a war head constructed in accordance with the invention.

Referring to the drawing in particular, the invention embodied therein comprises a device for ejecting containers 3 and particulate ammunition containers which is shown in FIG. 1 includes a shell 2 of a war head 1 having the spray ammunition containers 3 therein.

Further, a bellows 4 is provided, which is placed concentrically to the longitudinal axis 5 of the war head 1. The bellows 4 have circumferentially arranged concave, pockets 6, e.g., directed toward the longitudinal axis 5, into which the spray ammunition or containers 3 are placed. The two front or end faces of the bellows 4 are, which is not evident in the drawing, covered by bulkhead plates of shell 2. On inflating the bellows 4 from the inside with pressure gas it changes its form to become a cylinder, i.e., the pockets 6 are rapidly turned inside out and in the process the spray ammunition 3 is ejected. Instead of four pockets 6, for example, three packets could also be provided.

Pressurizing the bellows 4 takes place through the gas generator 7. The gas generator 7 comprises a tube or spray pipe 8 arranged concentrically to the longitudinal axis 5, which is damed up at its interior wall with a polyethylene film 9. Along the entire longitudinal axis 5, two ignition cords 10, 10′ extend in the center of the tube 8.

Figure 3:
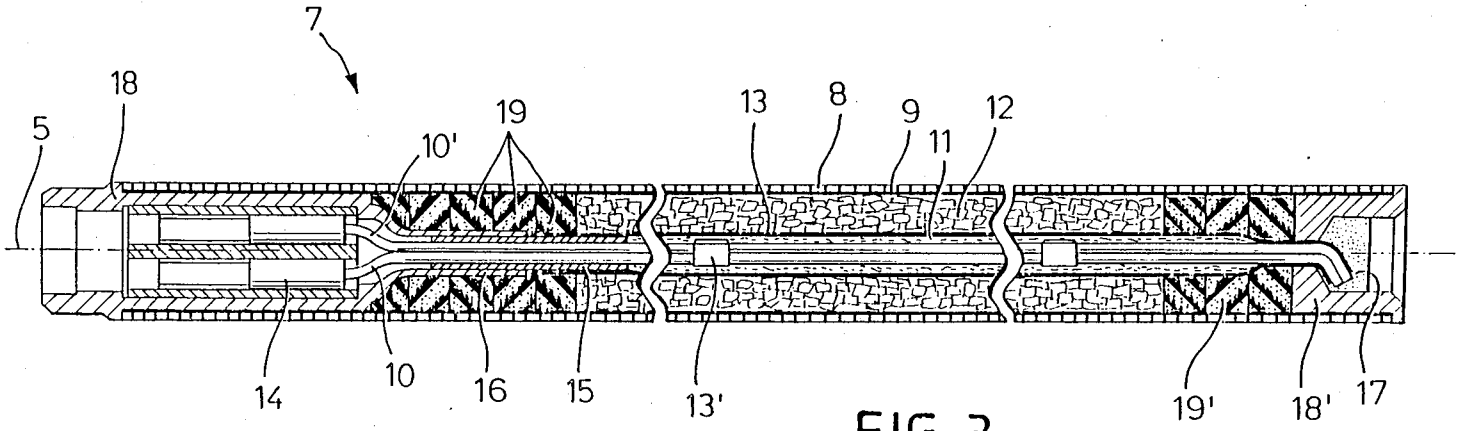
FIG. 3 is an enlarged partial longitudinal section corresponding to FIG. 2.

The ignition cords 10, 10′ can be formed by, for example, a so-called hivelite cord, which is formed of a metallic tube into which the ignition mixture of cesium hydroboron, the oxidizing agent of potassium nitrate and a polethyleneglycol binding agent are placed. When using several ignition cords 10, 10′ as shown in FIG. 3, they are held together by a stray 13′.

Around the ignition cords 10, 10′ a particle ignition mixture 11 is arranged, e.g., an ignition mixture, which upon burning generates a particle rich hot gas. The particle ignition mixture 11 can, for example consist of a mixture of a compound giving off oxygen, like potassium nitrate, and a metal powder, for example boron or aluminum powder.

The particle ignition mixture 11 is surrounded by a tubular film 13, preferentially shrink tubing. In the annular space between the particle ignition mixture 11, a shrink tubing strap 13, the tube 8, the daming film 9, a platelett propellant charge 12 is placed. The shrink tubing 13 prevents the particle ignition mixture 11 from becoming mixed with the propellant charge 12 in the non-actuated state of the device and effects a specific, for example, a uniform distribution of the particle ignition mixture 11 around the ignition cords 10, 10′.

The propellant charge 12 comprises, for example, a double base propellant substance. According to FIG. 3, into the ignition cords 10, 10′ pyrotechnic delay elements 14 are integrated which can be initiated by an amplification charge not shown here. The delay elements 14 are contained in a casing, which ends via a nozzle 16 in tube 15. It is clear that the ignition cords 10, 10', the particle ignition mixture 11, and the shrink tubing 13 form a unit. This unit is connected with the tube 15 via the shrink tubing 13.

The closure parts 18, 18' close the spray tube 8 at both ends. In the closure part 18' the other end of the ignition cords 10, 10' are fastened, for example by an adhesive agent. Further, on the ignition cords 10, 10' inert bodies, for example in the form of rings 19, 19' of synthetic foamed material are provided in any axial distribution, for example, between the propellant charge 12 and the delay element 14 as well as at the other end of the tube 8.

To eject the spray ammunition 3, initially the war head cover 2, for example by rip cords not shown here, is removed. Subsequently, the ignition cords 10, 10', delayed by the delay element 14, are ignited. The ignition cords 10, 10' lead to the burning of the particle ignition mixture 11 the shrink film 13 is destroyed, which presses the hot particles of the ignition mixture 11 between the plateletts of the propellant charge 12 and ignites them. In this way, the ignition of the propellant charge 12 takes place simultaneously over the entire length with corresponding rapid anc controllable pressure built-up.

The daming up means in the form of the film 9 is require, because a sufficiently high pressure and a sufficiently high temperature is required, in order to ignite the propellant charge 12.

On the other hand, opening the daming 9 leads to a sudden pressure drop. The hot particles of the ITLX ignition cord 10, 10' accordingly have not only the task of effecting the ignition of the propellant charge 12 but they also prevent the propellant charge 12 from becoming extinguished as a consequence of the pressure drop following the opening of the daming 9.

Through the described structure of the gas generator 7 a rapid and uniform pressure build-up can be achieved in the bellows 4 and thus a high ejection acceleration of the spray ammunition 3.

A significant advantage of the device according to the invention is that the ejection acceleration or in general the outgoing behaviour of the spray ammunition can be adapted relatively easily to the particular demands and can be varied over the length of the bellows.

Apart from the construction, e.g., the ratio of the overall area of the openings of the spray tube 8 to its surface area, the kind of daming and the nature and amount of the ignition cords 10, 10', this can take place through the nature, amount and axial distribution of the propellant as well as the configuration of the propellant charge 12 and its axial distribution.

Figure 2:
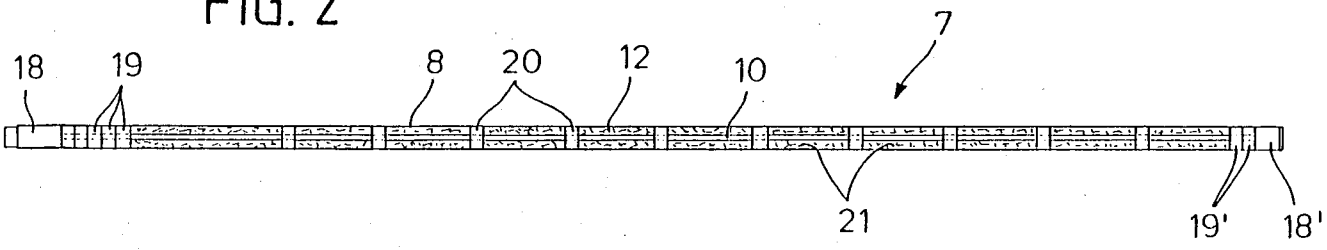
FIG. 2 is a longitudinal sectional view of the gas generator of FIG. 1.

In particular, it is possible, according to FIG. 2, to separate the propellant charge 12 through partition walls 20, extending radially arranged at axial distance from each other, of an inert material between the shrink tubing 13 and the tube 9 into individual segments or annular chambers 21. The partition walls 20 can comprise, for example, of rings of a synthetic or foamed material.

Into each of these chambers 21, a given propellant amount can be filled specifically, for example in order to achieve uniform distribution of a given propellant amount along tube 8.

Along the tube 8 and separated by bulkhead plates, several bellows 4 can also be arranged in succession, each filled with spray ammunition, and the manner of ejection of the spray ammunition of the individual bellows 4 can be controllable in a similar manner, so for example, through the propellant charge amounts provided for each bellows 4 in the gas generator 7, for example also through further pyrotechnic delay elements integrated into the ignition cords 10, 10'. Either the thereby generated overall ignition units with the corresponding kind, amount and distribution of the propellant charge 12 in a single tube 8, can be separated from each other through partition wall or bulkhead plates or several separate complete gas generators 7 can be arranged successively in on one row in the longitudinal axis of the war head 5.

What is claimed is:

1. A device for ejecting containers particulary containers of ammunition from a war head, comprising a longitudinally elongated bellows having a longitudinal axis with a plurality of concave circumferentially arranged radially outwardly opened container receiving pockets; bulk head means for closing said bellows at both ends thereof; a gas generator for inflating the bellows including a gas permeable tube provided with a plurality of partition walls subdividing the interior of the gas permeable tube into a plurality of individual chambers extending along the tube said gas permeable tube being arranged substantially concentrically in the interior of and extending the entire length of said bellows, a solid propellant particulate positioned in said chambers of said gas-permeable tube, a material damming up said gas-permeable tube positioned within said gas permeable tube towards the outside of said gas permeable tube and said material opens by pressure generated by ignition of said propellant charge, and an ignition chain for said propellant charge including at least one ignition cord which extends centrally over substantially the entire length of said tube, and a particulate ignition mixture comprising boron and at least one of aluminum and magnesium particles placed around said ignition cord.

2. A device according to claim 1 wherein said propellant charge has particles formed as plateletts.

3. A device according to claim 1 wherein said propellant charge comprises a double base propellant substance.

4. A device according to claim 1 wherein said material for damming up the gas-permeable tube comprises a synthetic material film located at the interior wall of said tube.

5. A device according to claim 4 wherein said synthetic material film comprises a polyethylene.

6. A device according to claim 1 wherein said ignition cord includes a pyrotechnic delay element.

7. A device for ejecting containers particularly containers of ammunition from a warhead, comprising: a longitudinally elongated bellows having a longitudinal axis with a plurality of concave circumferentially arranged radially outwardly opened container receiving pockets; bulk head means positioned at each end of said longitudinally elongated bellows for closing said bellows at both ends thereof; a gas generator for inflating the bellows including a gas permeable tube arranged substantially concentrically in the interior of said bellows and extending the entire length of said bellows; a solid propellant in the form of particulate material, said gas permeable tube including a plurality of partition walls forming a plurality of individual chambers extending along the gas permeable tube, said particulate propellant being positioned in said chamber of said gas permeable tube; gas permeable tube damming means including material for damming up said gas permeable tube positioned within said gas permeable tube toward the outside of said solid propellant and being consumable so that upon being pressurized said propellant gases flow to the outside of said gas permeable tube; and, an ignition charge structure including at least one ignition cord and a particulate ignition mixture including boron and at least one of aluminum and magnesium particles positioned around said ignition cord, said ignition charge structure extending centrally over substantially the entire length of said tube.

8. A device for ejecting containers particulary containers of ammunition from a warhead, comprising: a longitudinally elongated bellows having a longitudinal axis with a plurality of concave circumferentially arranged radially outwardly opened container receiving pockets; bulk head means for closing said bellows at both ends thereof; a gas generator for inflating the bellows including a gas permeable tube arranged substantially concentrically in the interior of and extending the entire length of said bellows; a solid particulate propellant positioned in said gas-permeable tube; a material damming up said gas-permeable tube positioned within said gas permeable tube towards the outside of said gas permeable tube, said material being comprised of a synthetic material film and said material being consumerable so that upon being pressurized said propellant gases flow to the outside of said gas permeable tube; and, an ignition chain structure for igniting said propellant charge, said ignition change structure including at least one ignition cord with an ignition mixture placed around said ignition cord said ignition change structure extending centrally over substantially the entire length of said tube.

* * * * *